US007287988B1

(12) United States Patent
Peng et al.

(10) Patent No.: US 7,287,988 B1
(45) **Date of Patent: *Oct. 30, 2007**

(54) BOARD-TO-BOARD CONNECTOR

(75) Inventors: Yung-Chi Peng, Taipei Hsien (TW); Hsin-Ta Chen, Taipei Hsien (TW)

(73) Assignee: Cheng Uei Precision Industry Co, Ltd., Tu-Cheng, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/552,860

(22) Filed: Oct. 25, 2006

(51) Int. Cl.
*H01R 12/00* (2006.01)

(52) U.S. Cl. ..... 439/74

(58) Field of Classification Search ..... 439/74, 439/83

See application file for complete search history.

(56) References Cited

U.S. PATENT DOCUMENTS 5,876,217 A 3/1999 Ito et al.
6,338,630 B1 * 1/2002 Dong ..... 439/74
6,846,187 B2 * 1/2005 Yu ..... 439/74
6,884,089 B2 * 4/2005 Obikane et al. ..... 439/74
2006/0264074 A1 * 11/2006 Chang et al. ..... 439/74

OTHER PUBLICATIONS

U.S. Appl. No. 11/567,793, filed Dec. 7, 2006.*

* cited by examiner

*Primary Examiner*—Neil Abrams
*Assistant Examiner*—Phuongchi Nguyen
(74) *Attorney, Agent, or Firm*—WPAT, P.C.; Anthony King

(57) ABSTRACT

A board-to-board connector according to the present invention includes an insulating housing and a plurality of terminals. The insulating housing has a plurality of terminal grooves, and the electric terminals are accommodated in the terminal grooves. A second receiving portion locates outside the sidewall for accommodating a branch, which is arranged in a base part of the terminal upwardly. Further, the base part protrudes a welding part downwardly exploded outside. When the board-to-board connector is soldered to a printed circuit board, the superfluous tin is guided to the branch and. So that it prevents the superfluous tin from flowing into the contact area of the terminal.

3 Claims, 3 Drawing Sheets

BOARD-TO-BOARD CONNECTOR

BACKGROUND OF THE INVENTION

1. Field of the Invention

The present invention relates to a board-to-board connector, and more particularly, to a board-to-board connector with improved terminals.

2. The Related Art

In the electronic industry, the board-to-board connector is used to make electric connection between circuits on different printed circuit board. Printed circuit boards must be joined together by connectors in a manner to effectively and reliably interconnect the circuit on one printed circuit board to the circuit of another printed circuit board, in order to establish signal communication or power connection.

U.S. Pat. No. 5,876,217, issued Mar. 2, 1999, the disclosure which is hereby incorporated by reference in its entirety, discloses a board-to-board connector for effecting an electrical connection between two circuit boards. The board-to-board connector has an insulating housing and a plurality of terminals fixed to the insulating housing and arranged at regular intervals therein.

However, when the board-to-board connector is soldered to a printed circuit board, the superfluous tin may contaminate the contact area of the terminals, further resulting a fail connection.

SUMMARY OF THE INVENTION

Accordingly, an object of the present invention is to provide a board-to-board connector, which prevents the tin from contaminating the contact area at soldering process.

The board-to-board connector includes an insulating housing and a plurality of electric terminals. The insulating housing has a plurality of terminal grooves, and the electric terminals are accommodated in the corresponding terminal grooves. A second receiving portion locates outside the sidewall for accommodating a branch which is arranged in a base part upwardly. Further, the base part protrudes a welding part downwardly.

Because the branch of the electric terminal, the tin is guided onto the branch when the board-to-board connector is soldering tin.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
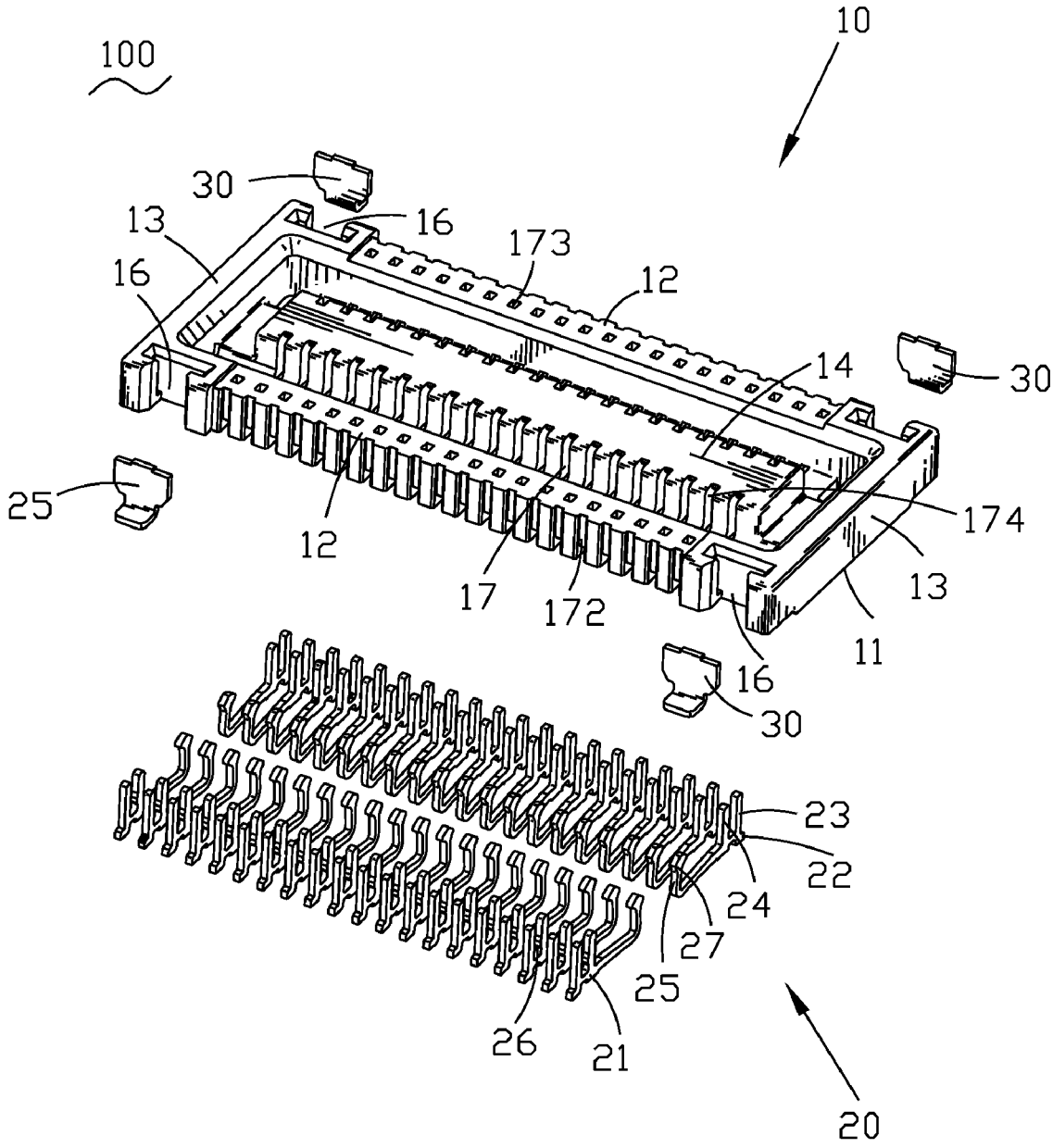
FIG. 1 is an exploded view of a board-to-board connector.
Figure 2:
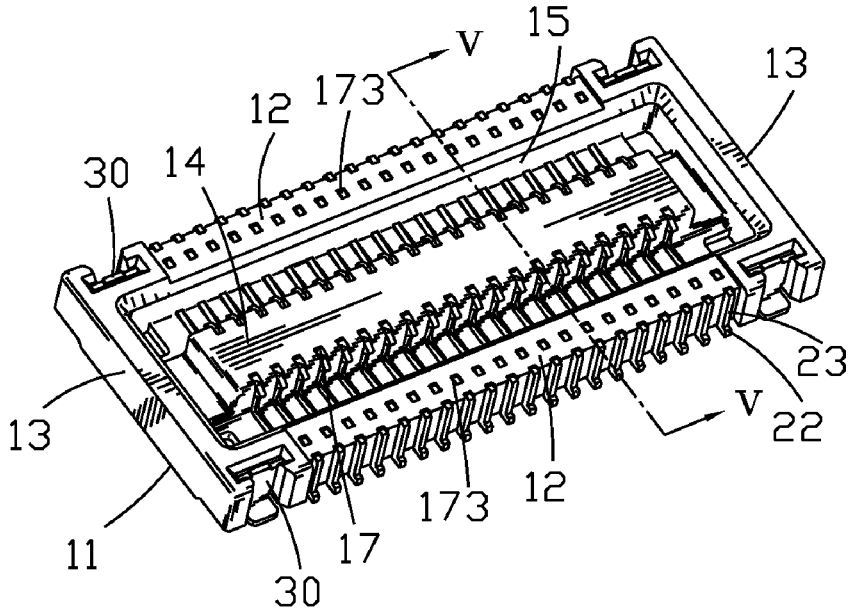
FIG. 2 is a perspective view of the board-to-board connector.
Figure 3:
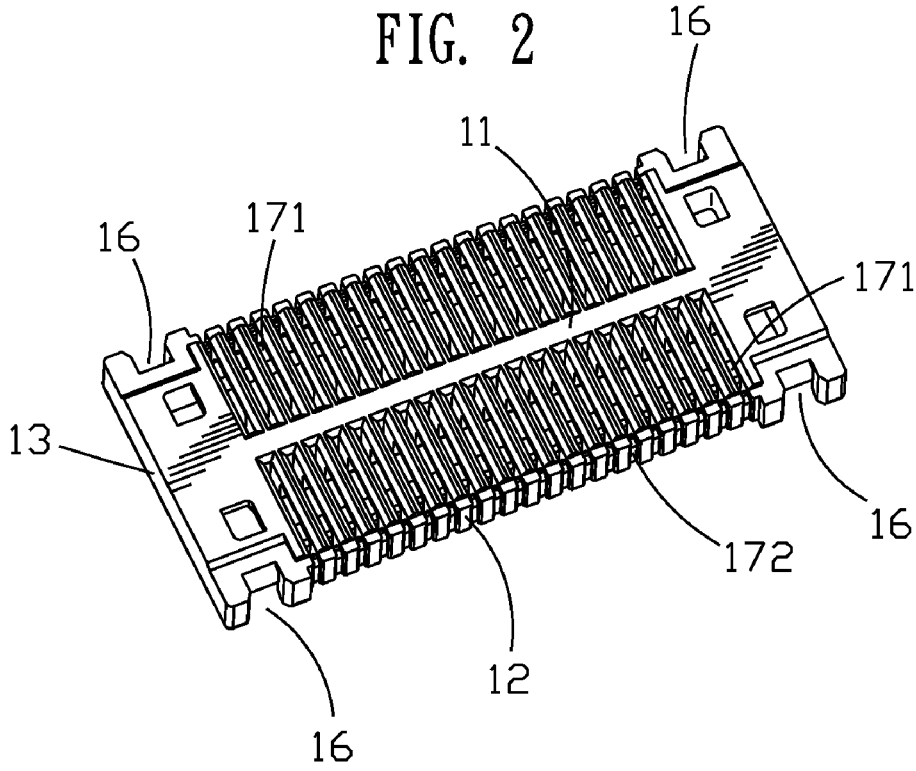
FIG. 3 is a perspective view of an insulating housing of the board-to-board connector.

With reference to FIG. 1, FIG. 2 and FIG. 3, a board-to-board connector 100 of the present invention is illustrated. The board-to-board connector 100 includes an insulating housing 10, a plurality of terminals 20 and fitting nails 30 accommodated in the insulating housing 10.

The insulating housing 10 is rectangle shaped and has a flat base plate 11. A pair of first sidewalls 12 protrudes upwards from the opposite longwise sides of the base plate 11. Further more, a pair of second sidewalls 13 protrudes upwards from another opposite sides of the base plate 11. A central island portion 14 protrudes upwards from the center of the base plate 11. The central island portion 14 keeps a certain distance to the first sidewalls 12 and the second sidewalls 13, thus a periphery-receiving place 15 is formed between the central island portion 14 and sidewalls 12, 13. A plurality of fitting nail grooves 16 defined in the second sidewalls 13 perforates through the second sidewalls 13. A plurality of terminal grooves 17 is arranged at regular intervals along the length of the insulating housing 10 for receiving the electric terminal 20 therein. Each terminal groove 17 includes a first receiving portion 171 positioned in the base plate 11. The first receiving portion 171 communicates to outside and the periphery-receiving place 15. A second receiving portion 172 extends upwards along the outside of the first sidewall 12 from the first receiving portion 171. A third receiving portion 173 perforates through the first sidewall 12 from the first receiving portion 171 parallel to the second receiving portion 172. A fourth receiving portion 174 extends upwards along the central island portion 14 from the first receiving portion 171.

Figure 4:
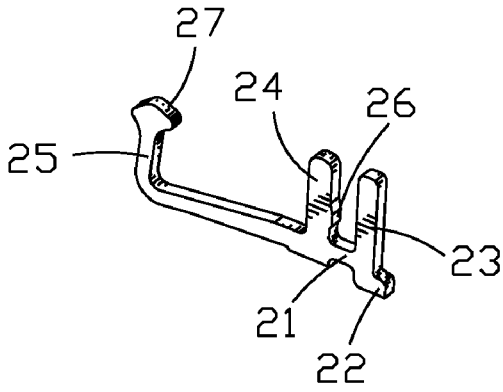
FIG. 4 is a perspective view of a terminal of the board-to-board connector.

With reference to FIG. 4, the electric terminal 20 includes a base part 21, a welding part 22 extending from the base part 21, a branch 23 protruding upwards between the base part 21 and the welding part 22. Further more, a holding part 24 protrudes upwards from the base part 21 parallel to the branch 23 with a salient part 26 defined thereon. A compression part 25 extends upwards from the base part 21 and further forms a touching part 27 at the free end of the compression part 25.

Figure 5:
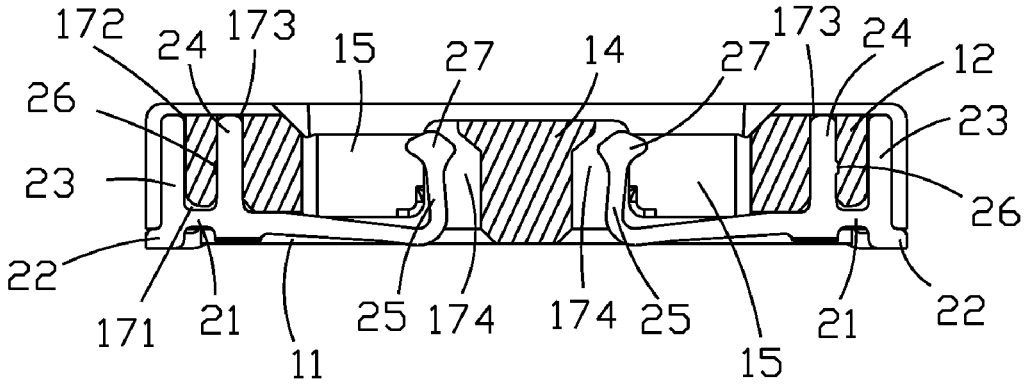
FIG. 5 is a cross-sectional view along the line V-V shown in FIG. 2.

With reference to FIG. 2 and FIG. 5, in assembly, the fitting nails 30 are held in the fitting nail grooves 16 of the insulating housing 10 for securing the board-to-board connector to a printed circuit board at soldering process. The electric terminals 20 are accommodated in corresponding terminal groove of the insulating housing 10. More particularly, the base part 21 of the electric terminal 20 is accommodated in the first receiving portion 171 of the terminal groove 17. The branch 23 is accommodated in the second receiving portion 172. The holding part 24 is inserted into the third receiving portion 173, and the salient part 26 is wedged in the third receiving portion 173. The compression part 25 is accommodated in the fourth receiving portion 174 with the touching part 27 exposed in the periphery-receiving place 15.

When the board-to-board connector 100 is soldered to a printed circuit board, the superfluous tin is guided to the branch 23. Therefore, it prevents the superfluous tin from flowing into the contact area of the terminal 20.

What is claimed is:

1. A board-to-board connector, comprising:

an insulating housing having a base plate, a pair of first sidewalls protruding upwards from opposing sides of said base plate, a pair of second sidewalls protruding upwards from said base plate on another opposite sides, a central island portion protruding from the center of the base plate and keeping a certain distance to the sidewalls, a periphery-receiving place formed between said central island portion and said sidewalls, a plurality of terminal grooves arranged at regular intervals along the length of the insulating housing for receiving corresponding electric terminal therein, said terminal groove further having a first receiving portion positioned in said base plate, a second receiving portion extending upwards from said first receiving portion along outside of said first sidewall, a third receiving portion perforating through said first sidewall from said first receiving portion, and a fourth receiving portion extending upwards from said first receiving portion along said central island portion;

a plurality of electric terminals accommodated in terminal grooves, having a base part extending in a longitudinal direction and accommodated in said first receiving portion, a welding part extending from said base part at a proximal end in the longitudinal direction and is exposed outside the insulating housing, a branch extending in an upward direction from said base part opposite to an extension direction of the wielding part, said branch accommodated in said second receiving portion, a holding portion extending from base part inserted into said third receiving portion to secure said terminal in said terminal groove, a compression part extending from base part and further formed a touching part exploded in said periphery-receiving place; and wherein no part of the branch extends beyond the wielding part in the longitudinal direction towards the proximal end.

2. The board-to-board connector as claimed in claim 1, wherein said insulating housing has at least one fitting nail groove in said second sidewall, and at least one fitting nail is accommodated in said fitting nail groove.

3. The board-to-board connector as claimed in claim 1, wherein said holding part of said electric terminal further comprising a salient part wedged in said third receiving portion.

* * * * *